US006920663B2

(12) United States Patent
Petit

(10) Patent No.: US 6,920,663 B2
(45) Date of Patent: Jul. 26, 2005

(54) TOOL FOR REMOVING HAIR FROM A BASIN DRAIN

(76) Inventor: Steven M. Petit, 606 Preston Dr., Suite 307, Bolingbrook, IL (US) 60440

( * ) Notice: Subject to any disclaimer, the term of this patent is extended or adjusted under 35 U.S.C. 154(b) by 213 days.

(21) Appl. No.: 10/242,820

(22) Filed: Sep. 13, 2002

(65) Prior Publication Data

US 2003/0056810 A1 Mar. 27, 2003

Related U.S. Application Data

(60) Provisional application No. 60/323,978, filed on Sep. 21, 2001.

(51) Int. Cl.[7] ..... B08B 9/02

(52) U.S. Cl. ..... 15/104.33; 15/104.05; 15/104.001

(58) Field of Search ..... 134/8; 15/104.001, 15/104.31, 104.05, 104.33

(56) References Cited

U.S. PATENT DOCUMENTS 267,306 A * 11/1882 Gall
834,135 A * 10/1906 Hymes
984,473 A * 2/1911 Cornelius
2,066,598 A * 1/1937 Wiessner
5,769,960 A * 6/1998 Nirmel
5,836,032 A * 11/1998 Hondo
6,094,765 A * 8/2000 Askenase
6,131,229 A * 10/2000 Lincuna
2001/0011398 A1 * 8/2001 Luoma

FOREIGN PATENT DOCUMENTS

GB 2 262 792 * 6/1993

OTHER PUBLICATIONS

"Hair Catcher Brush," as advertised on p. 42 in Miles Kimball Catalog. Miles Kimball is located at 41 W. Eight Avenue, Oshkosh, WI 54901—Phone No.: 920/231–3800; email address: csr@mileskimball.com.

* cited by examiner

*Primary Examiner*—Randall Chin
(74) *Attorney, Agent, or Firm*—Daspin & Aument, LLP; Jefferson Perkins

(57) ABSTRACT

A tool for removing hair and other debris from a basin drain is disclosed. The tool comprises a shaft having a first end and a second end and a mid-section. The first shaft end forms a handle and the second shaft end forms a hook. A method of using the tool is also disclosed.

12 Claims, 1 Drawing Sheet

TOOL FOR REMOVING HAIR FROM A BASIN DRAIN

CROSS-REFERENCE TO RELATED APPLICATIONS

This application claims priority from U.S. provisional patent application No. 60/323,978, filed Sep. 21, 2001.

FEDERALLY SPONSORED RESEARCH OR DEVELOPMENT

Not Applicable.

TECHNICAL FIELD

The present invention relates to a tool for removing hair or other debris from drains of basins, such as sinks or bathtubs, and to a method for using the tool.

BACKGROUND OF THE INVENTION

Various attempts have been made to create a tool to remove hair from a basin drain. See for example U.S. Pat. No. 5,836,032. However, such tools do not provide for easy access to remove the hair from the drain.

The present invention is provided to solve this and other problems.

SUMMARY OF THE INVENTION

It is an object of the invention to provide a tool for removing hair and other debris from a basin drain.

In accordance with the invention, the tool comprises a shaft having a first end, a second end and a mid-section. The first shaft end forms a handle and the second shaft end forms a hook.

It is contemplated that the shaft has a bend in its mid-section, and the bend forms an angle in the range of 160° to 164°, preferably 162°.

It is further contemplated that the shaft is formed of spring stainless steel.

It is still further contemplated that the handle comprises a loop of the shaft, and that the handle is plastic coated, preferably textured.

It is yet further contemplated that the tool has a length of 7½ inches.

It is further contemplated that the hook is generally pointed and that the tool is generally planar. Alternatively the handle and the hook end may be disposed at an angle, such that the tool is not generally planar.

It is a further object of the invention to provide a method for removing hair from a basin drain.

In accordance with this aspect of the invention, the method comprises providing a tool. The tool comprises a shaft having a first end and a second end and a mid-section. The first shaft end forms a handle and the second shaft end forms a hook. The hook is inserted into the drain and the hair is grasped with the hook and removed from the drain.

Other features and advantages of the invention will be apparent from the following specification taken in conjunction with the following drawings.

DETAILED DESCRIPTION OF THE INVENTION

Figure 1:
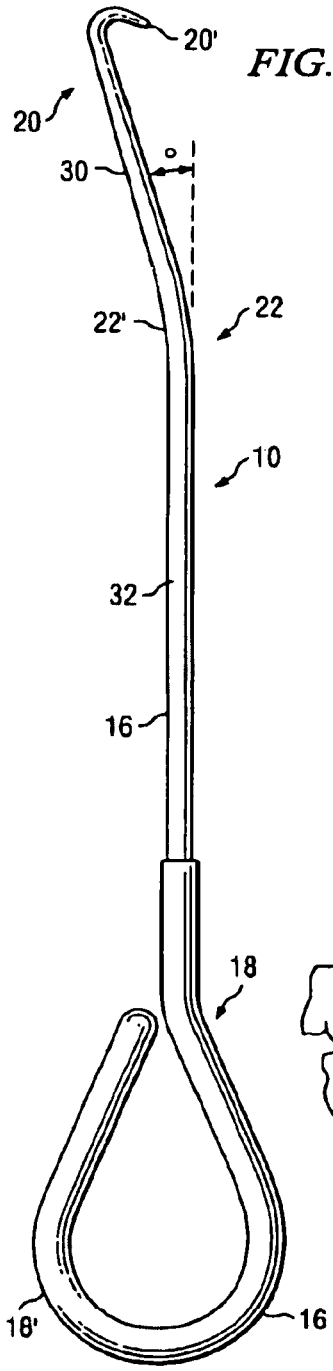
FIG. 1 is a plan view of a tool in accordance with the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
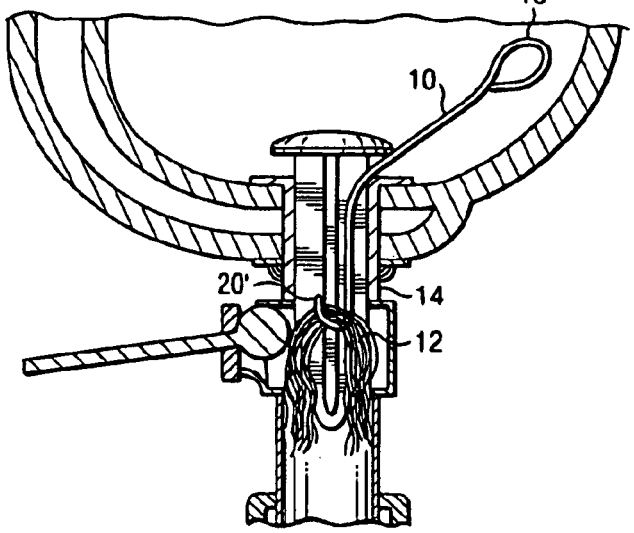
FIG. 2 is a side view of the tool of FIG. 1, illustrating a method of utilizing the tool to remove hair and other debris from a sink drain.

A tool 10 for removing hair 12 and other debris from a basin drain 14 is illustrated in FIGS. 1 and 2.

The tool 10 comprises a shaft 16 having a first end 18, a second end 20 and a midsection 22. The first shaft end 18 forms a handle 18'. The second shaft end 20 forms a hook 20', having a radius of ⅛ inch, plus or minus 1/32 of an inch.

The shaft 16 has a first end 18 which forms a handle 18' and a second end 20 which forms a hook 20'. The second end terminates in a tip 40. A first bend 42 in the shaft 16 is spaced by a first section 44, having a first length $l_1$, from the tip 40. A second bend 22' is spaced by a second, straight section 30, having a second length $l_2$, from the first bend 42. The first bend 42 is formed at an acute angle. The second length $l_2$ is several times the first length $l_1$. A third, straight portion 32 of the shaft 16 spaces the bend 22' from the handle 18'. The section 30 forms an obtuse angle with the section 32 in the range of 160° to 164°. The bend 22' is located 1.5 inches (+/−0.25 inches) from the end 20. The shaft 16 is formed of rigid, spring stainless steel.

Figure 3:
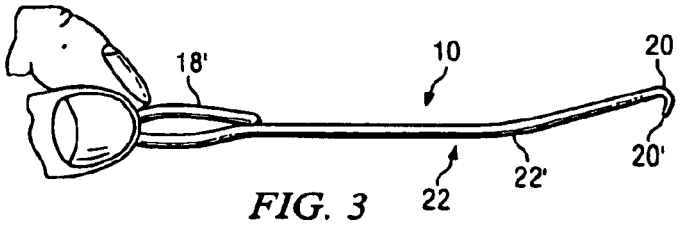
FIG. 3 is a plan view of an alternative embodiment of the invention.

The handle comprises a loop of the shaft 16, and the handle is plastic coated, preferably textured. The tool 10 has a length of 7½ inches. The hook 20' is generally pointed and the tool 10 is generally planar. Alternatively, as illustrated in FIG. 3, the plane formed by the handle 18', and the plane formed by the hook 20' may be disposed at a 90° angle, such that the tool is not generally planar, such that the plane formed by the hook 20' and the plane formed by the handle 18' are perpendicular to each other.

A method for removing hair from a basin drain is disclosed in FIG. 2.

The method comprises providing the tool 10. The hook 20' is inserted into the drain 14, and the hair 12 is grasped with the hook 20' and removed from the drain 14.

While specific embodiments have been illustrated and described, numerous modifications come to mind without significantly departing from the spirit of the invention and the scope of protection is only limited by the scope of the accompanying Claims.

I claim:

1. A tool for removing hair and other debris comprising:

a shaft having a first end forming a handle;

a hook terminating the shaft at a second end of the shaft opposed to the first end, the hook ending in a tip;

a first section of the shaft extending from the tip to a first bend, the first bend being formed at an acute angle such that the tip, first section and first bend form the hook, the first section having a first length;

a second, straight section of the shaft extending from the first bend to a second bend, the second section having a second length which is several times the first length; and a third, straight section of the shaft extending from the second bend to the handle, an angle of the second section relative to the third section being obtuse.

2. The tool of claim 1 wherein the angle formed by the second bend is in the range of 160° to 164°.

3. The tool of claim 2 wherein the second bend angle is 162°.

4. The tool of claim 1 wherein the shaft is formed of spring stainless steel.

5. The tool of claim 1 wherein the handle is plastic coated.

6. The tool of claim 5 wherein the plastic coated handle is textured.

7. The tool of claim 1 wherein the tool has a length of 7½ inches.

8. The tool of claim 1 wherein the tip is generally pointed.

9. The tool of claim 1 wherein the tool is generally planar.

10. The tool of claim 1, wherein the first end is looped to form the handle.

11. The tool of claim 1, wherein the second bend is located at a point in the range of 1 ¼ to 1¾ inches from the second end of the tool.

12. A tool for removing hair and other debris, comprising:

a shaft having a first end forming a handle;

a hook terminating the shaft at a second end of the shaft opposed to the first end, the hook ending in a tip;

a first section of the shaft extending from the tip to a first bend, the tip, the first section and the first bend forming said hook so as to be disposed in a first plane;

a second, straight section of the shaft extending from the first bend to a second bend, a third, straight section of the shaft extending from the second bend to the handle, an angle of the second section relative to the third section being obtuse; and the first end being looped in a second plane in order to form the handle, the first and second planes being disposed at ninety degrees from each other.

* * * * *